United States Patent [19]

Remmers

[11] Patent Number: 4,781,349

[45] Date of Patent: Nov. 1, 1988

[54] VENTILATED SHELF REINFORCING ELEMENT

[75] Inventor: Lee Remmers, Ocala, Fla.

[73] Assignee: Clairson International, Ocala, Fla.

[21] Appl. No.: 53,462

[22] Filed: May 26, 1987

[51] Int. Cl.[4] ..... A47G 29/02

[52] U.S. Cl. ..... 248/249; 248/250

[58] Field of Search ..... 248/235, 249, 250, 302; 108/108, 42, 107; 211/90, 153, 181; 134, 133

[56] References Cited

U.S. PATENT DOCUMENTS

| | | | |
|---|---|---|---|
| 815,060 | 3/1906 | Beebe . | |
| 914,639 | 3/1909 | Cormeny . | |
| 2,188,044 | 1/1940 | Hickman | 211/134 X |
| 2,207,115 | 7/1940 | Carr | 211/134 X |
| 2,448,319 | 8/1948 | Maranville | 211/134 |
| 2,850,172 | 9/1958 | Beckner . | |
| 2,932,408 | 4/1960 | Jacobson | 211/134 |
| 2,933,195 | 4/1960 | Radek . | |
| 2,998,886 | 9/1961 | Sides . | |
| 3,085,693 | 4/1963 | Shell | 211/134 |
| 3,321,089 | 5/1967 | Krikorian . | |
| 3,329,281 | 7/1967 | Ball . | |
| 3,355,134 | 11/1967 | Chesley | 211/134 X |
| 3,502,225 | 3/1970 | Oliver | 211/133 |
| 4,064,994 | 12/1977 | Ondrasik, II . | |
| 4,318,487 | 3/1982 | McCarthy | 108/42 X |
| 4,533,056 | 8/1985 | Krikorian . | |
| 4,624,376 | 11/1986 | Bertram . | |
| 4,669,692 | 6/1987 | Mastrodicasa | 248/250 |

FOREIGN PATENT DOCUMENTS

| | | | |
|---|---|---|---|
| 1237818 | 6/1960 | France | 211/134 |

*Primary Examiner*—J. Franklin Foss

*Attorney, Agent, or Firm*—Cushman, Darby & Cushman

[57] ABSTRACT

A reinforcing element for a ventilated rod-type shelf mounted to a vertical support such as a wall. The reinforcing element is slidingly engaged with the shelf so as to be disposed immediately below and perpendicular to the shelf. When so engaged with the shelf, in the preferred embodiment, the reinforcing element extends substantially from the vertical support to which the shelf is mounted to a forward longitudinal rod of the shelf so as to reinforce the longitudinal rods of the shelf and hence the transverse parallel rods of the shelf in ghe widthwise direction, against deformation from vertical loading.

14 Claims, 1 Drawing Sheet

VENTILATED SHELF REINFORCING ELEMENT

BACKGROUND OF THE INVENTION

The present invention relates to ventilated rod-type shelving systems and, in particular, to a reinforcing element for reinforcing shelves of such systems to minimize the likelihood of distortion of the shelf in the presence of vertical loading.

Ventilated rod-type shelving has been increasingly used because it is aesthetically pleasing and is simple to assemble by relatively unskilled homeowners. Shelving systems of this type generally include a plurality of shelves each of which include a number of spaced apart, parallel, transverse deck rods which are supported by longitudinal rods which extend at least along the rearward and forward edges of each of deck rods. Additional longitudinal rods can be provided along the length of the transverse deck rods. Each of the shelves so constructed is mounted to a vertical support structure such as a wall by a means of clips, brackets or the like which couple the rearward longitudinal rod to the wall. The forward longitudinal rod of the shelf is in turn supported by brackets disposed at each end thereof on the side walls of a closet, for example, in which the shelf is mounted and/or through the use of a number of brackets which extend from the vertical support structure to the frontal longitudinal rod from above or below so as to support the shelf in a horizontal plane.

It has been found that shelves of the type described above can have the disadvantage that when heavy objects are placed on the deck rods, the decking rods and/or the longitudinal supports thereunder can be distorted under the weight of such objects tending to give a bowed configuration to the shelf in the widthwise direction. It would, therefore, be desirable to provide a reinforcing element which can reinforce the shelf and prevent bowing distortion of the shelf under relatively heavy loads. However, it would be desirable to provide such a reinforcing element without substantially increasing the bulk of the ventilated shelving system or increasing the difficulty with which it is assembled so that it can still be easily and quickly assembled in operation by relatively unskilled homeowners and without the need for tools or excessive fastening hardware.

SUMMARY OF THE INVENTION

It is therefore an object of the present invention to enhance the ability of ventilated shelves to withstand vertical loads without deformation and yet without substantially increasing the bulk, weight and/or difficulty and time for assembling the shelving system.

In order to achieve the foregoing object, the present invention provides a reinforcing element that can be coupled to at least one (or more) longitudinal rod of the shelf at a first point along the length of the reinforcing element, the reinforcing element having a length such that it extends from the above-mentioned longitudinal rod at least to a second longitudinal rod of the shelf. The reinforcing element is further designed such that movement of the reinforcing element relative to the second longitudinal rod when the reinforcing element is coupled to the shelf is limited, whereby the shelf is reinforced against widthwise deformation from vertical loading.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENT

Figure 1:
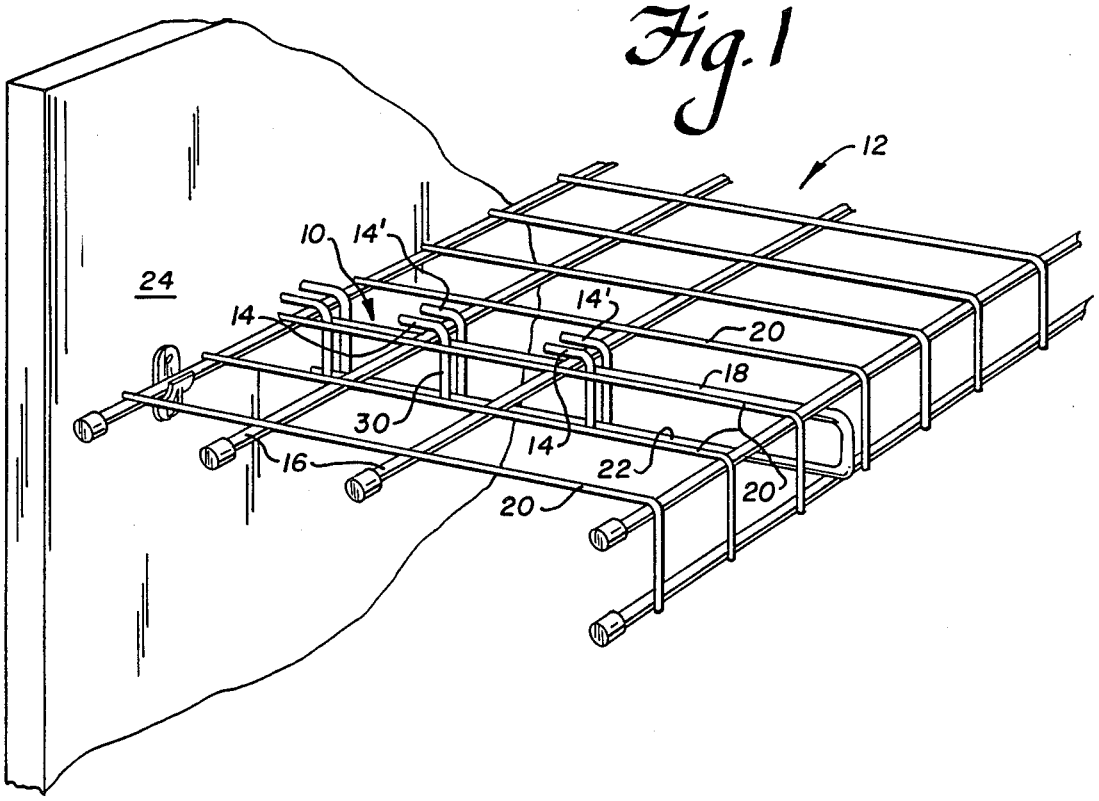
FIG. 1 is a perspective view of a reinforcement element formed in accordance with the present invention in position reinforcing a ventilated rod-type shelf.
Figure 2:
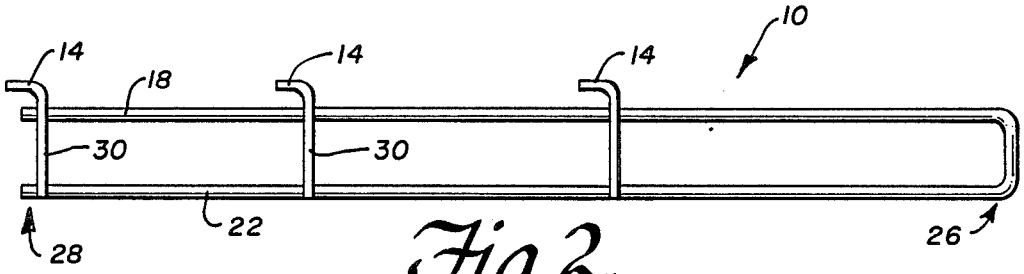
FIG. 2 is a side elevational view of a reinforcement member formed in accordance with the present invention.
Figure 3:
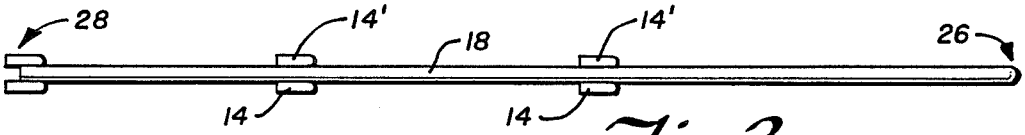
FIG. 3 is a top plan view of the reinforcement member of FIG. 2.
Figure 4:
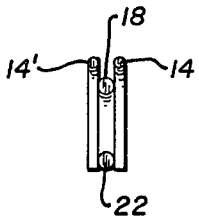
FIG. 4 is a rear elevational view of a reinforcement member formed in accordance with the present invention.

Referring to FIGS. 1 and 2, the reinforcing element 10 formed in accordance with the present invention is adapted to extend in the widthwise direction of an associated shelf 12. Further, element(s) 14 in the form of upwardly and rearwardly extending hooks for coupling the reinforcing member to longitudinal rod(s) 16 of the associated ventilated shelf 12 are provided so that the reinforcing element 10 can be coupled along its uppermost edge 18 to the associated shelf 12. In the illustrated embodiment, reinforcing element 10 is coupled to longitudinal rods 16 of shelf 12 by hooks 14, as will be described more fully below. However, it is to be understood that any suitable coupling elements that will attach the reinforcing member to the longitudinal rods of the shelf may be provided without departing from the spirit and scope of the present invention.

Hooks 14 are preferably provided at spaced locations along the length of element 10 corresponding to the spacing of the longitudinal rods 16 used in the formation of shelf 12. Further, each of the hooks 14 are preferably comprised of first and second individual hooks 14, 14' are mounted one on either side of the uppermost edge 18 of reinforcing element 10 so as to ensure a stable mounting the shelf and so that element 10 extends perpendicularly, downwardly from shelf 12.

While in the illustrated embodiment the reinforcing element extends the entire width of the shelf, it is to be understood that the reinforcing element will serve a reinforcing function as long as it extends at least between first and second longitudinal rods 16 of the shelf and the movement of the reinforcing element vertically relative to the longitudinal rods is limited. Thus, a reinforcing element which, for example, extends between the rearwardmost longitudinal rod of the shelf and a next adjacent longitudinal rod and includes means for coupling the reinforcing element to the next adjacent longitudinal rod will serve a reinforcing function because the amount that the reinforcing element can move vertically relative to the rear longitudinal rod of the shelf when a load is placed on the shelf is limited by the vertical height of the reinforcing element. More particularly, the vertically lowermost portion 22 of element 10 will engage the vertical support wall 24 disposed immediately behind the shelf when a load urges rods 16 and 20 downwardly. Thus, such contact will further inhibit the deformation of the parallel deck rods 20 of the shelf.

Likewise, a reinforcement element that has a length which extends at least from the front rod of the shelf to the next adjacent longitudinal rod and is coupled to that next adjacent longitudinal rod will also reinforce the shelf and prevent deformation along the width thereof between the front rod and the next adjacent rod. More particularly because the reinforcing element is disposed between the upper and lower frontal rods 16 of the shelf, as discussed more fully below, and is coupled to the next adjacent rod, it will resist a tendency of rods 16 and the deck rods members 20 between these two rods 16 to be deflected in a downward direction.

In the illustrated embodiment, however, to provide a maximum resistance to vertical deformation of the shelf across the entire width thereof, the reinforcing element preferably extends the entire width of an associated shelf and includes a means for coupling the reinforcing element to each longitudinal rod of the shelf except the forwardmost rod. Indeed, the most forward longitudinal rod of the shelf is preferably not coupled to the reinforcing element so as to facilitate the mounting of the reinforcing element to the shelf and to enhance the aesthetic appearance of the shelf.

In order to mount the reinforcing element of the present invention to a ventilated shelf, the reinforcing element 10 is diposed immediately below shelf 12 which has been mounted to a wall 24 or the like with hooks facing upwardly and rearwardly. The reinforcing element is then moved forwardly relative to the shelf so that the forwardmost end 26 passes between the forward longitudinal rods 16 of the shelf. The main body and rear end 28 of reinforcing element 10 are then rotated upwardly so that coupling hooks 14 or the like are disposed between a pair of deck wires and forward of the parallel longitudinal rods 16. Element 10 is then slid rearwardly so that hooks 14 slide over and engage longitudinal rods 16 of the shelf resulting in the position shown in FIG. 1. Once each of the longitudinal rods has engaged the innermost portion of each of coupling hooks 14, the rearward end 28 of reinforcing element 10 will preferably be disposed immediately adjacent the vertical support structure, such as wall 24, to which the shelf is mounted and the forwardmost portion of end 26 will continue to be disposed between the front rods of the shelf.

Thereafter, as a vertical load is applied to the planar surface of the shelf and the deck rods or wires 20 tend to bend and bow, otherwise forcing longitudinal rods 16 in a downward direction. However, reinforcing element 10 will resist this downward movement of rods 16 and enhance the structural integrity of the shelf. Indeed, the inter-engagement of the vertical support structure and the rearward end 28 and the vertically lowermost portion 22 of the reinforcing element, the disposition of the forward end 26 of the reinforcing member between the forward longitudinal rods of the shelf and the coupling relation of hooks 14 and longitudinal rods 16 will resist the tendency of parallel rods 20 to bow downwardly when loaded.

While in the illustrated embodiment the reinforcing element is formed from a rod-type element which has been folded at a mid-point 26 thereof into a hairpin shape which is held in fixed relation by extensions 30 of hooks 14, it is to be understood that the reinforcing element can be formed of any material such as, for example, wood, metal or plastic and/or can be a solid structure without departing from the spirit and scope of the present invention. However, the rod-type reinforcing member illustrated in the accompanying drawings is aesthetically pleasing and conisistent in design wih the associated shelf to thereby provide a shelving system which does not depart from the advantageous features of ventilating shelves in general.

While the present invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reinforcing element for a shelf having a plurality of spaced, transverse parallel rods and at least two longitudinal rods extending between and coupling the parallel rods to one another, said reinforcing element comprising:

a main body portion having a first end and a second end;

means for coupling said main body portion to a first longitudinal rod of the shelf so as to extend downwardly therefrom, said main body portion having a length such that when said coupling means couples said main body portion to the first longitudinal rod, said main body portion extends at least from the first longitudinal rod to a point immediately below and adjacent to a second longitudinal rod of the shelf, said means for coupling said main body portion to the first longitudinal rod of the shelf including a hook element mounted to said main body portion for engaging the first longitudinal rod of the shelf; and means for limiting the downward movement of said main body portion relative to the second longitudinal rod when said main body portion is coupled to the shelf, whereby the shelf is reinforced by the reinforcing element against widthwise deformation from vertical loading.

2. A reinforcing element as in claim 1, wherein said means for limiting the downward movement of said main body portion include means for coupling said main body portion to the second longitudinal rod.

3. A reinforcing element as in claim 2, wherein the means for coupling said main body portion to the first longitudinal rod includes a hook element for engaging the first longitudinal rod.

4. A reinforcing element as in claim 2, wherein said means for coupling said main body portion to the second longitudinal rod includes a hook element mounted to said main body portion for engaging the second longitudinal rod.

5. A reinforcing element as in claim 1, wherein said main body portion has a length substantially equal to the width of the shelf.

6. A reinforcing element as in claim 5, wherein a plurality of hook elements are mounted to said main body portion for coupling said main body portion to a plurality of longitudinal rods of the shelf.

7. A reinforcing element as in claim 6, wherein said main body portion includes a substantially elongated C-shaped rod element having upper and lower portions and an end portion, said upper and lower portions being rigidly coupled together by rod-type extensions of each of said hook elements.

8. A shelving system comprising, in combination:

at least one shelf member having a plurality of spaced, transverse parallel rods and at least two longitudinal rods extending between and coupling the parallel rods to one another; and at least one reinforcing element coupled to at least one said shelf, said reinforcing element including a main body portion having a length such that when said coupling means couples said main body portion to said first longitudinal rod, said main body portion extends at least from said first longitudinal rod to a point immediately below and adjacent to a second longitudinal rod of said shelf, said means for coupling said main body portion to said first longitudinal rod of the shelf including a hook element mounted to said main body portion for engaging said first longitudinal rod of said shelf, and means for limiting the downward movement of said main body portion relative to said second longitudinal rod when said main body portion is coupled to the shelf, whereby said shelf is reinforced by said reinforcing element against widthwise deformation from vertical loading.

9. A shelving system as in claim 8, wherein said means for limiting the downward movement of said main body portion include means for coupling said main body portion to said second longitudinal rod.

10. A shelving system as in claim 9, wherein said means for coupling said main body portion to said first longitudinal rod includes a hook element for engaging said first longitudinal rod.

11. A shelving system as in claim 9, wherein said means for coupling said main body portion to said second longitudinal rod includes a hook element mounted to said main body portion for engaging said second longitudinal rod.

12. A shelving system as in claim 8, wherein said main body portion has a length substantially equal to the width of said shelf.

13. A shelving system as in claim 12, wherein a plurality of hook elements are mounted to said main body portion for coupling said main body portion to a plurality of longitudinal rods of said shelf.

14. A shelving system as in claim 13, wherein said main body portion includes a substantially elongated C-shaped rod element having upper and lower portions and an end portion, said upper and lower portions being rigidly coupled together by rod-type extensions of each of said hook elements.

* * * * *